US005172841A

United States Patent [19]

Friedman

[11] Patent Number: 5,172,841

[45] Date of Patent: Dec. 22, 1992

[54] CORD DISPENSING APPARATUS

[76] Inventor: Leonard Friedman, 190 Kelly Blvd., Staten Island, N.Y. 10314

[21] Appl. No.: 706,002

[22] Filed: May 28, 1991

[51] Int. Cl.[5] ..... B65H 49/08

[52] U.S. Cl. ..... 225/42; 225/77; 225/85

[58] Field of Search ..... 225/42, 51, 77, 78, 225/85

[56] References Cited

U.S. PATENT DOCUMENTS

| | | | |
|---|---|---|---|
| 342,532 | 5/1886 | O'Brien | 225/85 |
| 1,443,358 | 1/1923 | Gerould | 225/78 |
| 2,163,064 | 6/1939 | Rominger | 225/85 |
| 2,175,835 | 10/1939 | Fraser | 225/77 |
| 2,215,813 | 9/1940 | Goetz | 225/85 |
| 3,696,697 | 10/1972 | Hoffman | 225/78 |

*Primary Examiner*—Hien H. Phan

*Attorney, Agent, or Firm*—Goodman & Teitelbaum

[57] ABSTRACT

A cord dispensing apparatus having a body member provided with a first portion for holding a mass, ball, spool and the like of cord, a second portion for mounting the body member on a wall, panel or frame to position the cord dispensing apparatus for use thereof, and a tab portion for cutting a selected length of the cord off from the mass, ball, spool and the like. The tab portion has a free edge and a transversely extending slot adjacent to the tab portion edge and extending parallel to the tab portion edge, with an opening extending through the tab portion edge into the slot. A cutting blade extends across the slot for cutting the selected length of cord when a portion of the cord is passed through the opening into the slot and forced against the cutting blade. Preferably, the walls of the slot are tapered downwardly from the opening to the opposite ends of the slot to facilitate the cutting of the cord when the cord is pulled towards either of the slot ends. The second portion for mounting the body member can either be a tongue and groove arrangement or a hook portion on the body member. The first portion for holding the mass, ball, spool and the like of cord can be a container or a rod mounted between flanges of the body member. A locking device can be provided on the body member to securely hold the cord during the cutting thereof.

20 Claims, 4 Drawing Sheets

CORD DISPENSING APPARATUS

BACKGROUND OF THE INVENTION

The invention relates to a cord dispensing apparatus and, more particularly, to a device for containing or holding a mass, ball, spool or the like of cord, the device including means for cutting off a desired length of the cord and means for removably mounting the device in a fixed position, so that the cord could be used for a particular function, such as for binding a pile of newspapers.

Presently, many state and local governments require discarded newspapers to be piled and tied with cord in order for the sanitation department to pick same up for disposal, where usually the collected pile of newspapers are recycled by the state or local governments in an effort to conserve natural resources. Therefore, there is presently a need for an efficient cord dispensing apparatus for binding newspapers and the like.

Cord dispensing apparatus is well known in the art, where U.S. Pat. No. 1,878,980 discloses a cord dispensing device having a cord receptacle or container for holding a ball or spool of cord directly above the cutting means which includes a razor blade, where the device is adapted to be mounted on a wall. U.S. Pat. No. 466,426 discloses a twine holder including a receptacle for receiving the cord therein, and a cutting device mounted on the outside of the receptacle. U.S. Pat. No. 1,784,258 discloses a twine holder and cutter including a base for holding the twine and a frame member disposed around the twine for supporting the cutting member, such as a razor blade.

However, the devices disclosed in the above patents are not particularly directed to an apparatus which can be easily used for binding a pile of newspapers, and therefore there is presently a need for a cord dispensing apparatus which can be used specifically for binding a pile of newspapers and the like.

SUMMARY OF THE INVENTION

It is accordingly an object of the present invention to provide a cord dispensing apparatus which avoids the afore-mentioned problems of the prior art devices.

Another object of the present invention is to provide a cord dispensing apparatus which provides means for holding a mass, ball, spool and the like of cord.

A further object of the present invention is to provide a cord dispensing apparatus having means for removably mounting the body thereof on a wall, panel or frame to position the cord dispensing apparatus for use thereof.

Still another object of the present invention is to provide a cord dispensing apparatus which includes means for cutting a selected length of cord off from a mass, ball, spool and the like of cord.

A further object of the present invention is to provide a cord dispensing apparatus, as described above, including a tab portion having a free edge with a transversely extending slot adjacent to the edge with an opening extending through the edge into the slot, and cutting means extending across the slot for cutting a selected length of cord when a portion of the cord is passed through the opening into the slot and forced against the cutting means.

Another object of the present invention is to provide a cord dispensing apparatus which includes locking means to securely hold the cord during the cutting thereof.

Yet another object of the present invention is to provide a cord dispensing apparatus as described above which is inexpensive to manufacture, and which can be easily used for a particular function, such as for binding a pile of newspapers.

Briefly, in accordance with the present invention, there is provided a cord dispensing apparatus having a body member provided with first means for holding a mass, ball, spool and the like of cord, second means for removably mounting said body member on a wall, panel or frame to position the cord dispensing apparatus for use thereof, and third means for cutting a selected length of cord off from the mass, ball, spool and the like. The third means includes a tab portion having a free edge and a transversely extending slot adjacent to the tab portion edge and extending parallel to the tab portion edge, with an opening extending through the tab portion edge into the slot. Cutting means extend across the slot for cutting the selected length of cord when a portion of the cord is passed through the opening into the slot and forced against the cutting means. Preferably, the walls of the slot are tapered downwardly from the opening to the opposite ends of the slot to facilitate the cutting of the cord when the cord, positioned in the slot, is pulled towards either of the slot ends. The second means for removably mounting the body member can either be a tongue and groove arrangement or a hook portion on the body member. The first means for holding the mass, ball, spool and the like of cord can be a container or a rod mounted between flanges of the body member. Locking means can be provided on the body member to securely hold the cord during the cutting thereof. The body member can be constructed from parts secured together or can be a one piece construction, where the body member can be fabricated from plastic or metal material.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of preferred embodiments in which.

In the various figures of the drawings, like reference characters designate like parts.

DESCRIPTION OF THE PREFERRED EMBODIMENTS

Figure 1:
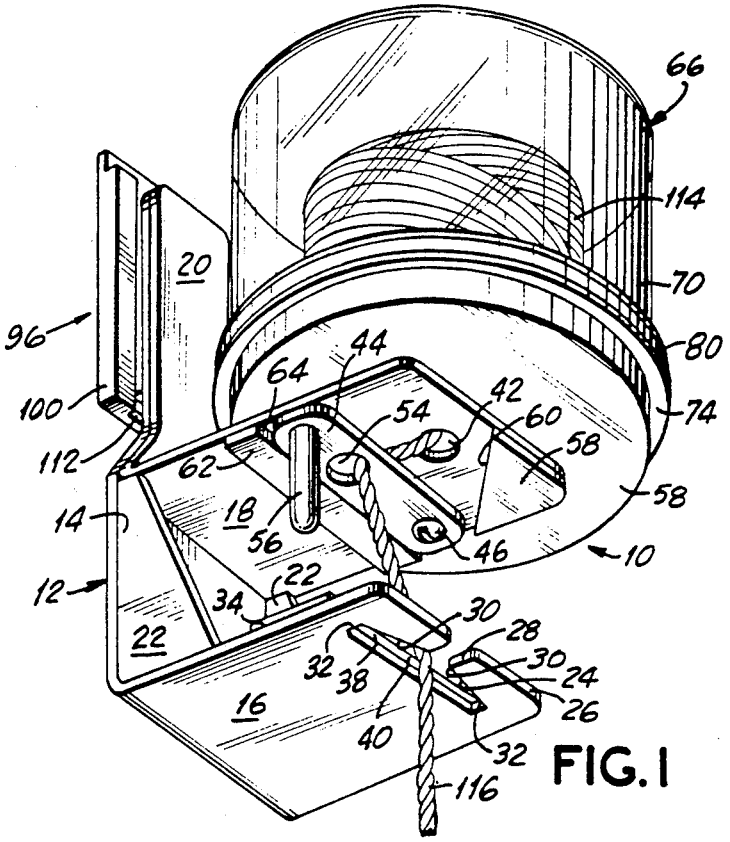
FIG. 1 is a perspective view of a cord dispensing apparatus according to the present invention.

Referring now to the drawings, FIGS. 1 through 5 show a cord dispensing apparatus 10, according to the present invention, including an F-shaped body member 12. The body member 12 includes a vertical body member portion 14 having a tab portion 16 extending perpendicularly outward from the bottom of the body member portion 14. A tongue portion 18 is spaced above the tab portion 16 in a parallel arrangement. The tongue portion 18 is secured to the body member portion 14 by a perpendicularly bent securement portion 20, where any suitable securing means, such as adhesive, cement and the like, could be used to connect the securement portion 20 to an upper part of the body member portion 14. However, it is understood, that the body member portion 14 could be made in a one piece construction, preferably fabricated from a plastic material or could be made from metal, so that the securement portion 20 would not be necessary, where the tongue portion 18 would merely project perpendicularly outward from the body member portion 14. Preferably, support brackets 22 are provided on opposite sides of the body member 12, seated against the body member portion 14 and secured between the tab portion 16 and the tongue portion 18 to maintain the parallel arrangement between the tab portion 16 and the tongue portion 18.

A transversely extending slot 24 is provided in the tab portion 16 adjacent to the free edge 26 thereof, where the slot 24 extends parallel to the free edge 26. A centrally located opening 28 extends through the free edge 26 into the slot 24. The slot 24 has walls 30 tapering downwardly from the opening 28 to opposite ends 32 of the slot 24 to facilitate the cutting of the cord, as will be described in more detail below.

Figure 2:
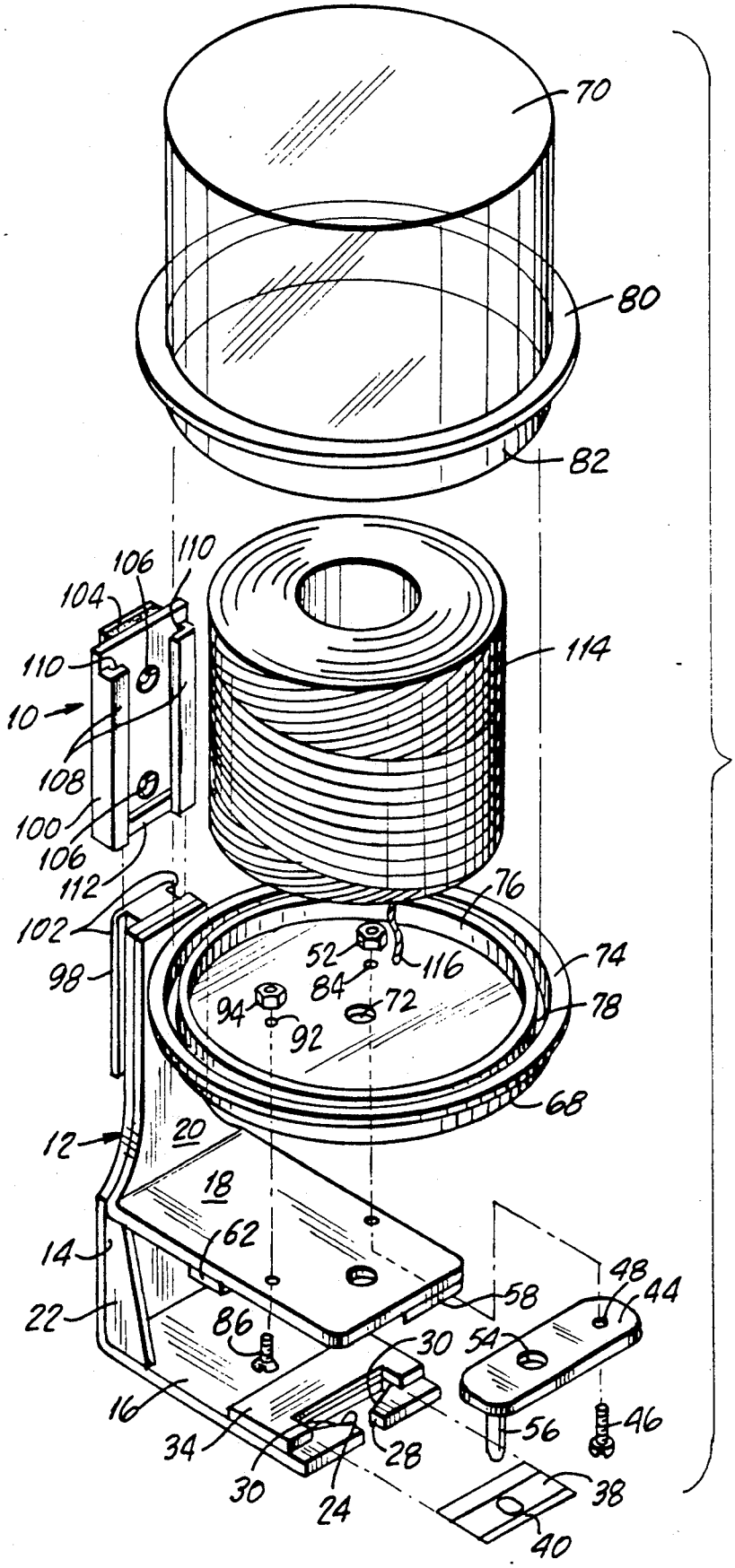
FIG. 2 is a perspective exploded view of the apparatus of FIG. 1.

As best shown in FIG. 2, a housing part 34 is transversely securely positioned on the upper surface of the tab portion 16 adjacent to the slot 24. The housing part 34 has a recess 36 therein to receive a conventional razor blade 38 so that the cutting edge 40 of the razor blade 38 will extend out of the recess 36 and extend across the slot 24, as best shown in FIG. 1, in order to cut the cord, as set forth below. It is noted, that the razor blade 38 can either be removably held in the recess 36 of the housing part 34, or the razor blade 38 can be fixedly secured within the recess 36 of the housing part 34 by conventional securing means, such as an adhesive, cement and the like.

The tongue portion 18 has a hole 42 therethrough, the hole 42 being in alignment with the slot 24, for the reasons set forth below. Additionally, a bar member 44 is pivotally secured to the tongue portion 18 by conventional means, such as a screw 46 passing through a hole 48 in the bar member 44 and a hole 50 provided in the tongue portion 18 for threaded engagement in a nut 52. A hole 54 is provided through the bar member 44, and a handle-like pin 56 is perpendicularly secured on the free end of the bar member 44 opposite the pivot screw 46.

A triangular abutment member 58 is secured by conventional means on the underside of the tongue portion 18 in a corner thereof so that the hypotenuse provides a stop edge 60 to position the hole 54 of the bar member 44 in alignment with the hole 42 of the tongue portion 18. A rectangular abutment member 62 is disposed transversely across the underside of the tongue portion 18 to provide a second stop edge 64 facing the stop edge 60, where the bar member 44 is disposed therebetween. Thus, the pivoting of the bar member 44 is limited to the distance between the two stop edges 60, 64, as will be explained below.

A container 66, preferably fabricated from a plastic material is mounted on the upper surface of the tongue portion 18. The container 66 includes a base portion 68 and a cover portion 70 which can be transparent. As best shown in FIG. 2, the base portion 68 has a centrally located hole 72 through the bottom thereof, and a rim 74 around the peripheral upper portion thereof. An inner ring 76 extending upwardly from the bottom is spaced from the rim 74 to provide a circular recess 78. The cover portion 70 has a peripheral flange 80 adjacent to the bottom portion 82 thereof. Accordingly, the bottom portion 82 of the cover portion 70 is received in the circular recess 78 of the base portion 68 in a force-fit to secure the cover portion 70 on the base portion 68. In the closed position the rim 74 and the flange 80 are spaced apart to facilitate the pulling off of the cover portion 70 from the base portion 68 when it is desired to open the container 66.

The base portion 68 is secured directly on the upper surface of the tongue portion 18 by suitable means, such as by the screw 46 additionally extending through a hole 84 in the bottom of the base portion 68 before the screw 46 is threadedly engaged in the nut 52. Preferably, another screw 86 extends upwardly through a hole 90 in the tongue portion 18 and through a hole 92 in the bottom of the base portion 68 for threaded securement in a nut 94 to securely hold the base portion 68 on the tongue portion 18. In this secured arrangement, the hole 72 of the base portion 68 is positioned to be in alignment with the hole 42 of the tongue portion 18.

Preferably, the upper part of the body member portion 14 above the tongue portion 18 is reduced in width, together with the securement portion 20 secured thereon, and removable mounting means 96 are attached to the rear surface of the upper part of the body member portion 14. As best shown in FIG. 2, the mounting means 96 includes a tongue member 98 and a groove member 100. The tongue member 98 is secured by suitable means to the upper part of the body member portion 14, and includes vertically extending, outwardly projecting, spaced apart tongues 102. The groove member 100 includes an adhesive strip 104 on the rear surface thereof and screw receiving holes 106 through the rear wall thereof for mounting the groove member 100 on a wall, panel or frame. The walls 108 of the groove member 100 are inwardly bent toward each other to provide grooves 110 for removably receiving the tongues 102 therein. Additionally, a stop member 112 is provided inside the bottom of the groove member 100 to abut against the bottom of the tongue member 98 when the tongue member 98 when the tongue member 98 is secured to the groove member 100 in a tongue and groove securement arrangement.

Figure 3:
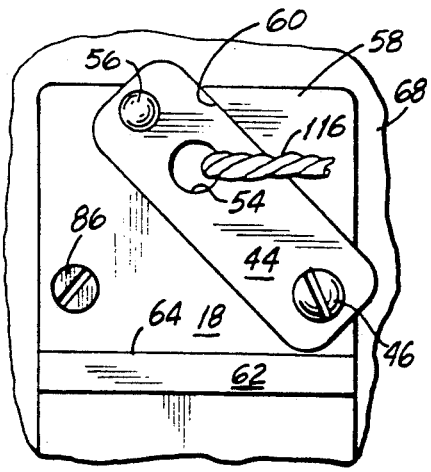
FIG. 3 is a fragmented view showing the locking device of FIG. 1 in an unlocked position.

In operation, the groove member 100 is first secured to a wall, panel or frame in a desired position, and then the tongue member 98 is secured therein to position the cord dispensing apparatus 10 for use thereof. With the cover portion 70 off, a mass ball or spool 114 of cord 116 is placed on top of the base portion 68 with the end of the cord 116 extending through the hole 72 in the base portion 68 and also through the hole 42 in the tongue portion 18. Preferably, the bar member 44 is pivoted against the stop edge 60 of the abutment member 58 so that the hole 54 of the bar member 44 is in alignment with the hole 42 of the tongue portion 18, thus the end of the cord 116 is also inserted through the hole 54 of the bar member 44, as shown in FIG. 3. The bottom portion 82 of the cover portion 70 is now inserted into the recess 78 of the base portion 68 so that the container 66 is now closed to hold the mass, ball or spool 114 therein.

Figure 4:
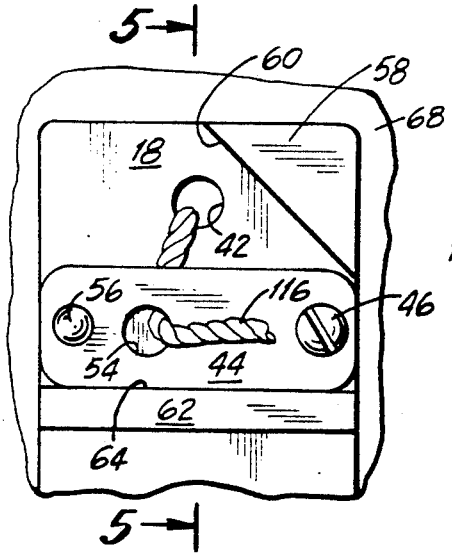
FIG. 4 is a fragmented view showing the locking device of FIG. 1 in a locked position.
Figure 5:
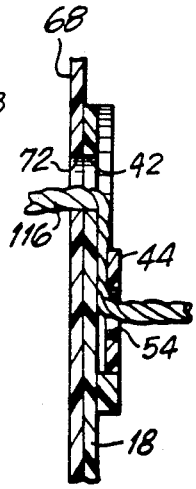
FIG. 5 is a fragmented sectional view taken along line 5—5 of FIG. 4.

In the above-mentioned position, the end of the cord 116 is now pulled to a selected length and the item, such as a pile of newspapers, is bundled up with the cord 116. After tying the item, the handle-like pin 56 is moved to pivot the bar member 44 away from the first pivot position against the stop edge 60, in which the holes 42, 54 are in alignment, to a second pivot position against the stop edge 64 of the abutment member 62 so that the holes 42, 54 are now out of alignment with each other, as best shown in FIGS. 1, 4 and 5. In this second pivot position, the cord 116 is sandwiched between the bottom surface of the tongue portion 18 and the inner surface of the bar member 44, as best shown in FIG. 5, so that the cord 116 is securely held and locked therebetween. With the cord 116 locked in position, the cord 116 is now passed through the opening 28 into the slot 24, and is then pulled to either side so that the tapered wall 30 of the slot 24 forces the cord against the cutting edge 40 of the razor blade 38, thus cutting the cord 116 off from the mass, ball or spool 114.

Accordingly, when it is desired to bundle another pile of newspapers, the handle-like pin 56 is moved by the user to the bar member 44 back to the first pivot position against the stop edge 60, so that the holes 42, 54 are again in alignment with each other. The end of the cord 116 can now be freely pulled to unwind same from the mass, ball or spool 114 held in the container 66, so that a selected length of the cord 116 can once again be pulled out to tie the next pile of newspapers, where the above procedure is repeated.

Figure 6:
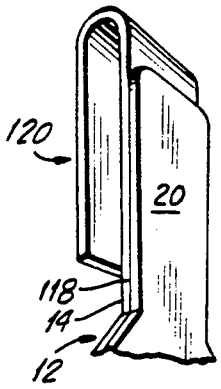
FIG. 6 is a fragmented perspective view showing a modified mounting hook portion for the apparatus of FIG. 1.

FIG. 6 shows a modified embodiment of the removable mounting means. Accordingly, the upper part 118 of the body member portion 14 of the body member 12 is bent back over itself to form a hook portion 120. The hook portion 120 can easily be hooked onto a wall, panel or frame to position the cord dispensing apparatus 10 for use thereof.

Figure 7:
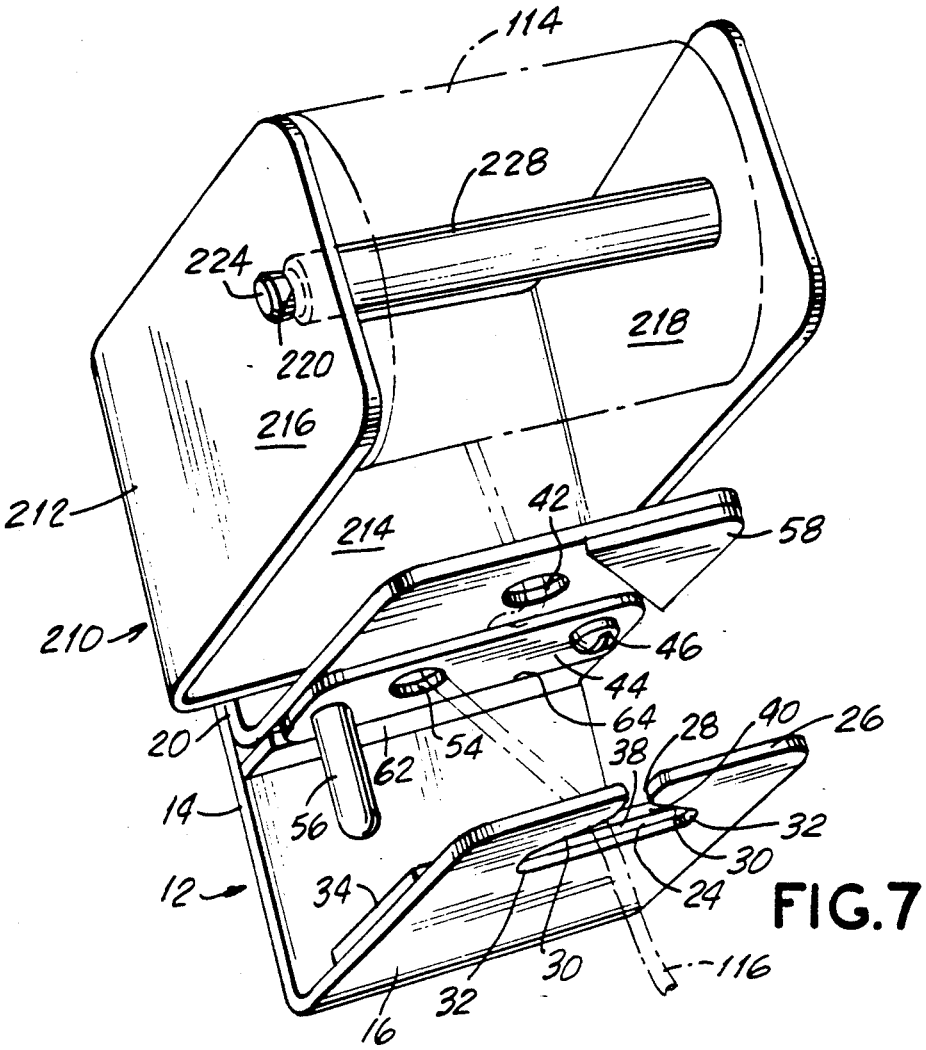
FIG. 7 is a perspective view of a modified cord dispensing apparatus according to the present invention.
Figure 8:
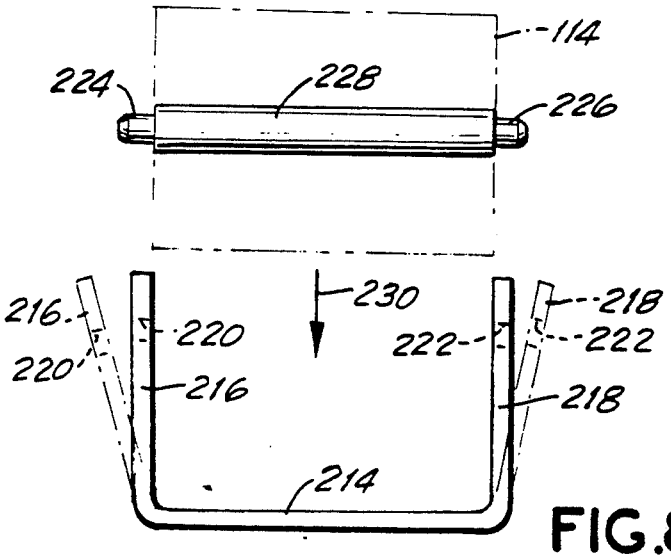
FIG. 8 is a bottom view of the apparatus of FIG. 7 with parts removed to show the holding device for a spool of cord.

FIGS. 7 and 8 show a modified cord dispensing apparatus 210 according to the present invention. The cord dispensing apparatus 210 is substantially similar to the above-mentioned cord dispensing apparatus 10 except that the container 66 has been removed therefrom, and a different type of holding means 212 has been added thereto, as will be explained below.

Accordingly, the cord dispensing apparatus 210 substantially includes the above-mentioned F-shaped body member 12, the vertical body member portion 14 having the tab portion 16 and the tongue portion 18 parallel to the tab portion 16, the securement portion 20, the tab portion slot 24, the opening 28 in the free edge 26 of the tab portion 16, the tapering walls 30 of the slot 24 which extend downwardly to the opposite ends 32 thereof, and the housing part 34 to receive the razor blade 38 so that the cutting edge 40 thereof extends across the slot 24. The cord dispensing apparatus 210 also includes the above-mentioned hole 42 in the tongue portion 18, the bar member 44 pivotly secured to the tongue portion 18 by the screw 46, the hole 54 in the bar member 44, the handle-like pin 56 attached to the end of the bar member 44, the triangular abutment member 58 having the stop edge 60, and the rectangular abutment member 62 having the second stop edge 64.

It is noted, because in this embodiment there is no weight on the tongue member 18, the support brackets 22 of the first mentioned cord dispensing apparatus 10 have been eliminated. In place of the above-mentioned support brackets 22, the rectangular abutment member 62 is disposed directly against the body member portion 14 for support of the tongue portion 18.

The holding means 212 includes a bight portion 214 and two flanges 216, 218 extending perpendicularly outwardly from opposite ends of the bight portion 214. The bight portion 214 is secured by suitable means, such as an adhesive, cement and the like, to the securement portion 20 so that the flanges 216, 218 extend outward perpendicularly to the tongue portion 18, as shown in FIG. 7. Aligned holes 220, 222 are provided in the flanges 216, 218, respectively, to receive the reduced end portions 224, 226, respectively, therein of a rod 228 to removably secure the rod 228 between the flanges 216, 218.

Accordingly, the spool 114 of cord 116 is inserted onto the rod 228, and then the flanges 216, 218 are pulled apart so that the rod 228 with the spool 114 thereon can be downwardly inserted, in the direction of arrow 230, between the flanges 216, 218, as shown in FIG. 8, to allow the ends 224, 226 of the rod 228 to be inserted into the holes 220, 222 of the flanges 216, 218 in the position shown in FIG. 7. In this position, the cord 116 of the spool 114 can now be inserted through the hole 42 in the tongue portion 18 and also through the hole 54 of the bar member 44, as mentioned above. The above-mentioned procedure for bundling a pile of newspapers and for cutting the cord 116 can now be followed, where repeating said procedure is not thought necessary.

Figure 9:
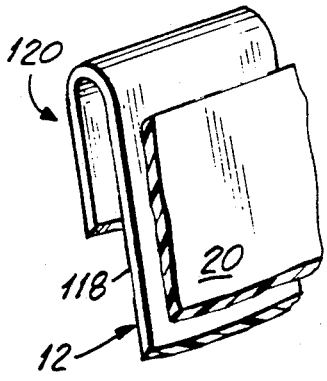
FIG. 9 is a fragmented perspective view showing a mounting hook portion for the apparatus of FIG. 7.

The cord dispensing apparatus 210 can be provided with the above-mentioned removable mounting means 96 attached to the rear surface of the upper part of the body member portion 14 in the manner discussed above, or as shown in FIG. 9, the upper part 118 of the body member portion of the body member 12 can be bent back over itself to form the hook portion 120, in the same manner as the modified embodiment of the removable mounting means shown in FIG. 6. Here again, the hook portion 120 can easily be hooked onto a wall, panel or frame to position the cord dispensing apparatus 210 for use thereof.

It is noted, as indicated above, that the body member 12 of the cord dispensing apparatus 210 could be made in a one piece construction, preferably fabricated from a plastic material, so that the securement portion 20 and the bight portion 214 of the holding means 212 would not be necessary.

Figure 10:
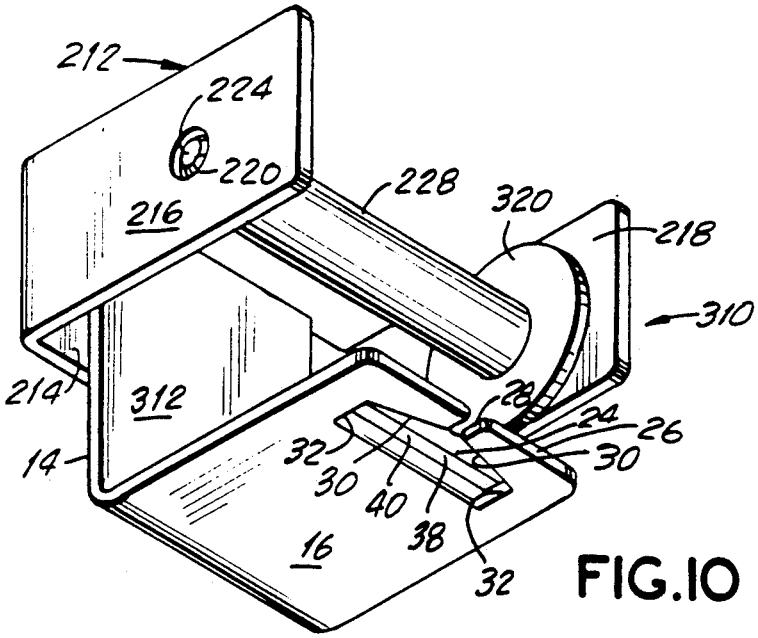
FIG. 10 is a perspective view of a further modified cord dispensing apparatus according to the present invention.
Figure 11:
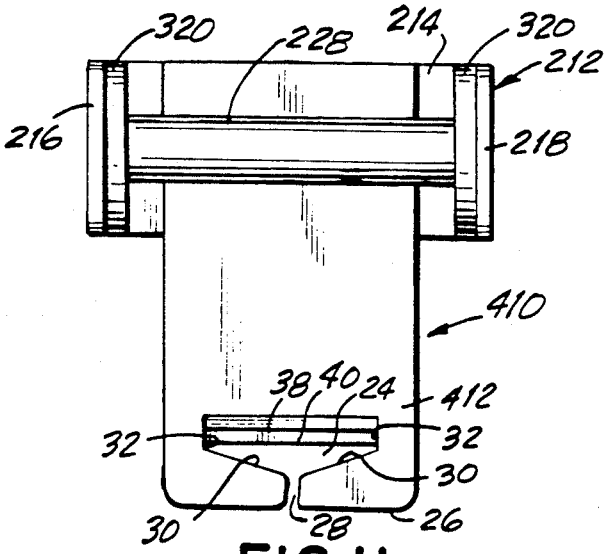
FIG. 11 is a front view of a still further modified cord dispensing apparatus according to the present invention.

FIG. 10 shows a further modified cord dispensing apparatus 310. The cord dispensing apparatus 310 is substantially similar to the above-mentioned cord dispensing apparatus 210 except that the tongue portion 18 and the securement portion 20 thereof have been removed therefrom together with the bar member 44 and the parts associated therewith.

Accordingly, the cord dispensing apparatus 310 includes a body member 312 having the vertical body member portion 14 with the tab portion 16 extending perpendicularly outwardly from the bottom thereof, the tab portion slot 24, the opening 28 in the free edge 26 of the tab portion 16, the tapering walls 30 of the slot 24 which extend downwardly to the opposite ends 32 thereof, and the housing part 34 (not shown) on the upper surface of the tab portion 16 to receive the razor blade 38 so that the cutting edge 40 thereof extends across the slot 24. The cord dispensing apparatus 310 also includes the holding means 212 having a bight portion 214 and two flanges 216, 218 extending perpendicularly outwardly from opposite ends of the bight portion 214, and the aligned holes 220, 222 provided in the flanges 216, 218 to receive the reduced end portions 224, 226 of the rod 228 to secure the rod 228 between the flanges 216, 218.

As shown, the body member portion 14 is secured by suitable means, such as an adhesive, cement and the like, on top of the bight portion 214. Accordingly, in a reversal of positions, the bight portion 214 could be secured on top of the body member portion 14, or as mentioned above, the cord dispensing apparatus 310 could be a one piece construction, preferably fabricated from a plastic material.

Preferably, removable round guard members 320 are mounted on the opposite end portions 224, 226 of the rod 228 adjacent to inner walls of the flanges 216, 218. Alternatively, the guard member 320 can be fixedly secured by suitable means directly onto the inner walls of the flanges 216, 218 to receive the end portions 224, 226 therethrough.

In operation, the spool 114 of cord 116 is inserted on the rod 228, then the guard members 320 are inserted on opposite ends thereof if the guard members 320 are of the removable type, and the ends 224, 226 of the rod 228 are inserted into the holes 220, 222 of the flanges 216, 218, and through the guard members 320 if the guard members are of the fixed type, in the manner mentioned above. Thereafter, the selected length of cord 116 is pulled off the spool 114 to bundle a pile of newspapers, after which the cord 116 is inserted through the opening 28 and into the slot 24 of the tab portion 16, and then pulled towards either end 32 of the slot 24 to cut the cord 116, as mentioned above.

As indicated above, the cord dispensing apparatus 310 can be provided with either the above-mentioned mounting means 96 or the above-mentioned hook portion 120.

FIGS. 11–14 show a still further modified cord dispensing apparatus 410. The cord dispensing apparatus 410 is very similar to the above-mentioned cord dispensing apparatus 310 except that the tab portion 16 and the body member portion 14 are not bent perpendicular to each other, as in the above body member 312, but rather are formed together to provide a straight body member portion 412 including the tab portion 16 which extends vertically downwardly from the bight portion 214 of the holding means 212.

Accordingly, the cord dispensing apparatus 410 further includes the tab portion slot 24, the opening 28 in the free edge 26 of the tab portion 16, the tapering walls 30 of the slot 24 which extend downwardly to the opposite ends 32 thereof, the housing part 34 mounted on the rear surface of the tab portion 16 to receive the razor blade 38 so that the cutting edge 40 extends across the slot 24, the two flanges 216, 218 extending perpendicularly outwardly from opposite ends of the bight portion 214, the aligning holes 220, 222 provided in the flanges 216, 218 to receive the reduced end portions 224 of the rod 228 to secure the rod 228 between the flanges 216, 218, and the removable or fixed round guard members 320 mounted on opposite ends of the rod 228 adjacent to the inner walls of the flanges 216, 218 or mounted directly on the inner walls of the flanges 216, 218.

Figure 13:
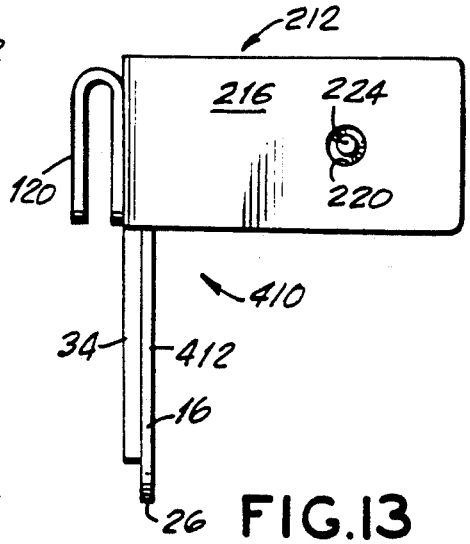
FIG. 13 is a left side view of the apparatus of FIG. 11.
Figure 12:
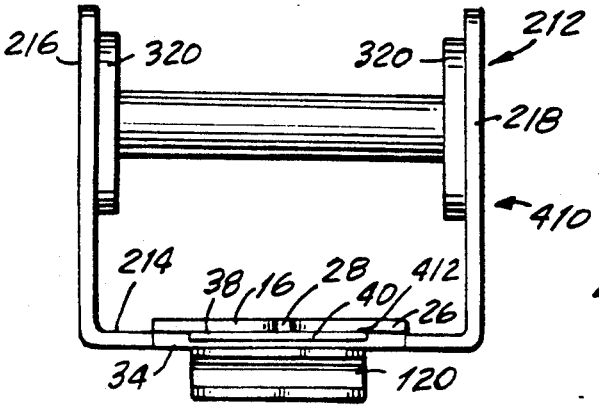
FIG. 12 is a bottom view of the apparatus of FIG. 11.
Figure 14:
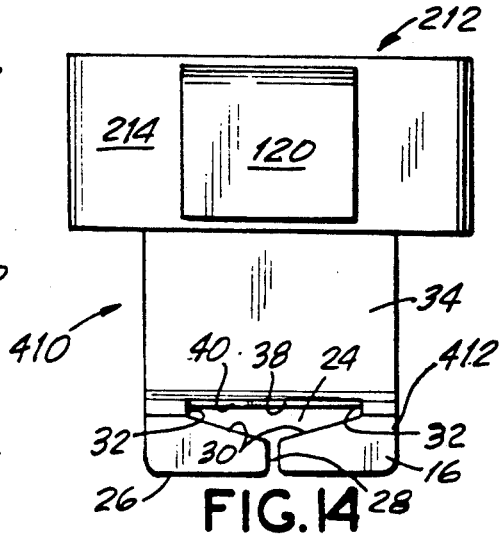
FIG. 14 is a rear view of the apparatus of FIG. 11.

Furthermore, the hook portion 120, as shown in FIG. 13, can be secured to the rear surface of the bight portion 214, or, as indicated above, the hook portion 120 could be a part of the body member portion 412 or tab portion 16, or the cord dispensing apparatus 410 could be a one piece construction, preferably fabricated from a plastic material. Alternatively, the cord dispensing apparatus 410 can be provided with the above-mentioned removable mounting means 96.

It is noted, that the cord dispensing apparatus 410 would operate and function in the same manner as the above-mentioned cord dispensing apparatus 310, where no further comment thereon is thought necessary.

Numerous alterations of the structures herein discussed will suggest themselves to those skilled in the art. However, it is to be understood that the present disclosure relates to preferred embodiments of the invention which are for purposes of illustration only, and are not to be construed as a limitation of the invention.

What is claimed is:

1. A cord dispensing apparatus comprising:

a body member provided with first means for holding a mass, ball, spool and the like of cord;

second means for mounting said body member on a wall, panel or frame to position said cord dispensing apparatus for use thereof;

third means for cutting a selected length of cord off from the mass, ball, spool and the like;

said third means including a tab portion having a free edge, said tab portion being provided with a transversely extending slot adjacent to said tab portion edge, said slot extending parallel to said tab portion edge;

a first opening extending through said tab portion edge into said slot;

said third means including cutting means extending across said slot for cutting the selected length of cord when a portion of the cord is passed through said first opening into said slot and forced against said cutting means; and said body member including locking means for securely holding the cord during the cutting thereof, said locking means including a tongue portion extending between said first means and said tab portion, said tongue portion having a second opening extending therethrough in alignment with said slot, a bar member pivotably secured to said tongue portion, said bar member having a third opening extending therethrough so that the cord is fed from said first means through said second opening of said tongue portion and then through said third opening of said bar member into said slot, so that in a first pivot position of said bar member, said tongue portion second opening and said bar member third opening are in alignment with each other to allow the cord to pass freely therethrough, and so that in a second pivot position of said bar member, said tongue portion second opening and said bar member third opening are out of alignment with each other to securely sandwich and lock the cord between said tongue portion and said bar member.

2. A cord dispensing apparatus according to claim 1, wherein said slot has walls tapering downward from said first to opposite ends of said slot to facilitate the cutting of the cord when the cord is in said slot and is pulled toward either of said slot ends.

3. A cord dispensing apparatus according to claim 1, wherein said cutting means includes a razor blade which is removably secured to said tab portion.

4. A cord dispensing apparatus according to claim 1, wherein said cutting means includes a razor blade which is fixedly secured to said tab portion.

5. A cord dispensing apparatus according to claim 1, wherein said tongue portion includes first stop means to prevent said bar member from pivoting beyond said first pivot position, and second stop means to prevent said bar member from pivoting beyond said second pivot position, so that said bar member can only pivot between said first and second pivot positions.

6. A cord dispensing apparatus according to claim 1, wherein said second means includes a first member having groove means and a second member having tongue means, one of said first and second members being mounted on the wall, panel or frame, and the other one of said first and second members being secured to said body member so that said groove means can receive said tongue means therein to mount said body member.

7. A cord dispensing apparatus according to claim 1, wherein said second means includes a hook portion provided on said body member for the mounting thereof.

8. A cord dispensing apparatus comprising:

a body member provided with first means for holding a mass, ball, spool and the like of cord;

second means for mounting said body member on a wall, panel or frame to position said cord dispensing apparatus for use thereof;

third means for cutting a selected length of cord off from the mass, ball, spool and the like;

said third means including a tab position having a free edge, said tab portion being provided with a transversely extending slot adjacent to said tab portion edge, said slot extending parallel to said tab portion edge;

a first opening extending through said tab portion edge into said slot;

said third means including cutting means extending across said slot for cutting the selected length of cord when a portion of the cord is passed through said first opening into said slot and forced against said cutting means; and said body member having a F-shaped construction including a vertical body member portion, said tab portion extending perpendicularly outward from a bottom of said body member portion, and a tongue portion extending perpendicularly outward from an intermediate part of said body member portion to be parallel to and spaced apart from said tab portion, said tongue portion being disposed between said first means and said tab portion, said tongue portion having a second opening extending therethrough in alignment with said slot, so that the cord is fed from said first means through said second opening of said tongue portion before being inserted into said slot.

9. A cord dispensing apparatus according to claim 8, wherein said first mean is an openable container for holding the mass, ball or spool of cord therein, said container having a lower part thereof secured on said tongue portion, said lower part of said container having an opening extending therethrough in alignment with said opening of said first tongue portion.

10. A cord dispensing apparatus according to claim 8, wherein said tongue portion includes means for securely holding the cord during the cutting thereof.

11. A cord dispensing apparatus according to claim 8, wherein said first means includes a pair of spaced apart outwardly extending flanges secured on said body member portion above said tongue portion, said flanges being perpendicular to said tongue portion, said flanges having aligned openings therein to receive a rod for holding the spool of cord thereon.

12. A cord dispensing apparatus according to claim 8, wherein said slot has walls tapering downward from said first opening to opposite ends of said slot to facilitate the cutting of the cord when the cord is in said slot and is pulled toward either of said slot ends.

13. A cord dispensing apparatus according to claim 8, wherein said cutting means includes a razor blade which is removably secured to said tab portion.

14. A cord dispensing apparatus according to claim 8, wherein said cutting means includes a razor blade which is fixedly secured to said tab portion.

15. A cord dispensing apparatus according to claim 8, wherein said second means includes a first member having groove means and a second member having tongue means, one of said first and second members being mounted on the wall, panel or frame, and the other one of said first and second members being secured to said body member so that said groove means can receive said tongue means therein to mount said body member.

16. A cord dispensing apparatus according to claim 8, wherein said second means includes a hook portion provided on said body member for the mounting thereof.

17. A cord dispensing apparatus comprising:

a body member provided with first means for holding a spool of cord;

second means for mounting said body member on a wall, panel or frame to position said cord dispensing apparatus for use thereof;

third means for cutting a selected length of cord off from the spool;

said third means including a tab portion having a free edge, said tab portion being provided with a transversely extending slot adjacent to said tab portion edge, said slot extending parallel to said tab portion edge;

a centrally located first opening extending through said tab portion edge into said slot;

said third means including cutting means extending across said slot for cutting the selected length of cord when a portion of the cord is passed through said first opening into said slot and forced against said cutting means;

said slot having a first wall extending inwardly from one side of said first opening, a second wall extending inwardly from an opposite side of said first opening, a first end wall connected to said first wall, a second end wall connected to said second wall, and a base wall spaced apart from said first and second walls and connected between said first and second walls, said base wall being parallel to said tab portion edge;

said first and second walls tapering inwardly from said first opening to said first and second end walls, respectively, to facilitate the cutting of the cord when the cord is in said slot and is pulled against either of said first and second walls toward either of said first and second end walls, respectively;

said cutting means including a razor blade having a cutting edge;

a housing being securely positioned on said tab portion adjacent to said base wall of said slot, said housing having a recess therein receiving said razor blade so that said cutting edge extends out of said recess and beyond said base wall to a cutting position extending across said slot and facing said tapered first and second walls of said slot; and said first means including a pair of spaced apart outwardly extending flanges secured on an upper part of said body member, said flanges being perpendicular to said upper part, said flanges having aligned second and third openings therein to receive a rod for holding the spool of cord thereon.

18. A cord dispensing apparatus according to claim 17, wherein said second means includes a hook portion provided on said upper part of said body member for mounting said body member.

19. A cord dispensing apparatus according to claim 17, wherein said tab portion extends perpendicularly outward from said body member.

20. A cord dispensing apparatus according to claim 17, wherein said second means includes a first member having vertically extending grooves on opposite sides thereof, and a second member having vertically extending tongues on opposite sides thereof, one of said first and second members being mounted on the wall, panel or frame, and the other one of said first and second members being secured to said body member, said grooves removably receiving said tongues therein in a sliding relationship to mount said body member, said first member including stop means to abut against said second member to stop the sliding movement of said second member to maintain a tongue and groove securement arrangement therebetween.

* * * * *